US007735822B2

(12) United States Patent
Aruga et al.

(10) Patent No.: US 7,735,822 B2
(45) **Date of Patent: *Jun. 15, 2010**

(54) SHEET CASSETTE AND INFORMATION PROCESSING APPARATUS

(75) Inventors: Yuichi Aruga, Okaya (JP); Toshihiro Imae, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/347,186

(22) Filed: Dec. 31, 2008

(65) Prior Publication Data

US 2009/0121413 A1 May 14, 2009

Related U.S. Application Data

(63) Continuation of application No. 11/506,540, filed on Aug. 17, 2006, now Pat. No. 7,487,961.

(30) Foreign Application Priority Data

Aug. 17, 2005 (JP) ..... 2005-236244

(51) Int. Cl.
*B65H 1/00* (2006.01)

(52) U.S. Cl. ..... 271/145; 271/157; 271/164

(58) Field of Classification Search ..... 271/145, 271/157, 152, 164, 117; 399/393
See application file for complete search history.

(56) References Cited

U.S. PATENT DOCUMENTS

| | | | | |
|---|---|---|---|---|
| 5,205,550 | A | 4/1993 | Perino et al. | |
| 5,451,039 | A | 9/1995 | Adachi et al. | |
| 5,474,287 | A | 12/1995 | Takahashi et al. | |
| 5,908,189 | A | 6/1999 | Flores et al. | |
| 6,050,565 | A * | 4/2000 | Fetherolf | 271/145 |
| 6,145,828 | A | 11/2000 | Arai et al. | |
| 6,830,245 | B2 | 12/2004 | Matsushima et al. | |
| 7,159,863 | B2 | 1/2007 | Murrell et al. | |
| 7,607,655 | B2 * | 10/2009 | Oomori et al. | 271/117 |
| 2002/0130459 | A1 | 9/2002 | Herrmann | |
| 2007/0040323 | A1 | 2/2007 | Aruga et al. | |

FOREIGN PATENT DOCUMENTS

| | | |
|---|---|---|
| JP | 2000-335755 | 12/2000 |
| JP | 2003-221134 | 8/2003 |

* cited by examiner

*Primary Examiner*—Patrick Mackey
*Assistant Examiner*—Jeremy Severson
(74) *Attorney, Agent, or Firm*—Nutter McClennen & Fish LLP; John J. Penny, Jr.

(57) ABSTRACT

A sheet cassette is adapted to be detachably attached to a cassette receiver of an information processing apparatus. A cassette body is formed with an opened space adapted to contain sheets therein. A stopper is operable to prevent a sheet from moving in a first direction to enter the opened space when a volume of the sheets contained in the opened space reaches a maximum containing capacity, while allowing the sheets contained in the opened space to move in a second direction to be fed to the information processing apparatus.

8 Claims, 9 Drawing Sheets

SHEET CASSETTE AND INFORMATION PROCESSING APPARATUS

BACKGROUND OF THE INVENTION

The present invention relates to a sheet cassette in which sheets of paper can be stacked over another and which is removably mounted in a cassette containing portion of a main body of an apparatus that uses the sheets, and the invention relates to an information processing apparatus having a cassette containing portion in and from which the sheet cassette can be mounted and removed.

An information processing apparatus such as a printer, copying machine, or facsimile generally includes a sheet conveying portion for conveying a sheet of paper to an information processing portion to allow information processing such as a printing process to be performed on the sheet. Conventional information processing apparatuses generally have a configuration in which a sheet cassette for containing sheets of paper to be conveyed by such a sheet conveying portion is removably mounted in a main body of the apparatus.

Various types of sheet feeding mechanisms for such information processing apparatus have been proposed, the mechanisms having a sheet cassette which is removably mounted in a cassette containing portion of an apparatus main body with sheets of papers stacked therein one over another and which has a guide wall for regulating a sheet feeding direction provided at the end thereof in the mounting direction, a sheet feeding unit which is provided on the apparatus main body such that it can contact a surface of the uppermost sheet in the cassette containing portion and which has a pickup roller for exerting a feeding force acting toward the guide wall to the surface of the sheet in contact therewith, and a control unit for controlling the operation of the sheet feeding unit. The mechanisms are configured such that the sheets contained in the sheet cassette are supplied to a conveying mechanism provided ahead of the guide wall one at a time starting with the uppermost sheet. Another proposed configuration of a sheet cassette includes a base plate for lifting up sheets of paper stacked in the sheet cassette while urging them toward a pickup roller.

A maximum amount of sheets to be stacked in the sheet cassette is set in advance. When the cassette is in an overloaded state in which the number of sheets of paper exceed the specified amount, an excessive load is likely to be generated at a sheet feeding unit for feeding the sheets one at a time from the uppermost sheet. When an excessive load is generated at the sheet feeding unit, a part for driving the sheet feeding unit can be damaged, and there will be an increase in the contact pressure on the sheets. Thus, the sheets are more liable to be wrinkled or torn, which can result in errors in sheet feeding.

Sheet cassette configurations have been proposed for use in sheet cassettes having a base plate as described above in order to prevent the generation of an excessive load to a sheet feeding unit by reducing the urging force of a base plate even when sheets of paper are set in the excess of the specified amount (for example, see Japanese Patent Publication No. 2000-335755A).

The technique disclosed in Japanese Patent Publication No. 2000-335755A can be adopted only in sheet cassettes having a base plate for lifting up sheets of paper and cannot accommodate sheet cassettes of other types.

Although most sheet cassettes have a mark indicating such a specified amount in general, they can be easily loaded with sheets of paper in the excess of the specified amount and can be mounted in an apparatus main body even in such an overloaded state. When a sheet cassette contains sheets of paper in the excess of a specified amount, an excessive load is generated at a sheet feeding unit as described above, and problems can occur including damage to a part for driving the sheet feeding unit and wrinkling or tearing of paper.

Some sheet cassettes are provided with a cover to close a part of a top side of the same that is open in order to regulate a sheet containing space above the bottom of the cassette and prevent sheets of paper from being loaded in the excess of a specified amount. However, even such a cassette may be forcibly loaded with sheets of paper in the excess of the specified amount. In such a case, since the pile of paper is sandwiched between the cover and the bottom of the cassette, an error or jam can sometimes be caused by a heavy load generated when a sheet is fed even though a feeding force is exerted on the sheet by the sheet feeding unit during sheet feeding.

While a sheet cassette is liable to have problems when overloaded as described above, it has not been possible to prevent sheets of paper from being set in a sheet cassette in the excess of a specified amount.

SUMMARY OF THE INVENTION

It is therefore an object of at least one embodiment of the invention to provide a sheet cassette which can be reliably prevented from being loaded with sheets of paper in excess of a specified amount and which is capable of feeding sheets smoothly without any problem in a sheet feeding operation and to provide an information processing apparatus having the same.

In order to attain the above described object, according to at least one embodiment of the invention, there is provided a sheet cassette adapted to be detachably attached to a cassette receiver of an information processing apparatus, the sheet cassette comprising:

a cassette body, formed with an opened space adapted to contain sheets therein; and a stopper, being movable relative to the cassette body and operable to prevent a sheet from moving in a first direction to enter the opened space when a volume of the sheets contained in the opened space reaches a maximum containing capacity, while allowing the sheets contained in the opened space to move in a second direction to be fed to the information processing apparatus.

With this configuration, the sheet cassette can be reliably prevented from being overloaded. It is therefore possible to reliably prevent problems resulting from overloading such as damage to a part for driving a sheet feeding unit of the information processing apparatus and wrinkling or tearing of paper caused by an excessive load generated at the sheet feeding unit.

Further, with this configuration, an operation of feeding a sheet to the apparatus can be smoothly performed.

The sheet cassette may further comprise a cassette cover, partly covering the opened space of the cassette body, wherein the stopper may be provided with the cassette cover.

With this configuration, the cassette cover makes it possible to prevent sheets from being loaded in the sheet cassette when the cassette is attached to the cassette receiver. When the top side of the sheet cassette attached to the cassette receiver opens on the outside of the apparatus, sheets can be loaded from the opened space. However, the sheets can cause a feeding error or jam because they may be skewed in the sheet cassette when loaded through the narrow opening. Since the cassette cover is provided, the sheet cassette must be removed from the cassette receiver to load it with sheets.

Thus, the sheets are properly set in the sheet cassette. In addition, since the stopper is provided on the cassette cover, sheets will not be caught between the cassette cover and the bottom of the cassette by being forcibly loaded in the excess of the specified amount. Thus, the loading of excess sheets can be prevented by the stopper.

The first direction may be opposite to the second direction.

With this configuration, a number of sheets within the specified amount can be smoothly fed while preventing excess sheets from being loaded.

The stopper may comprise:

a roller, adapted to come in contact with an uppermost one of the sheets contained in the space when the volume of the sheets reaches the maximum containing capacity;

a support shaft, rotatably supporting the roller and movable in the first direction and the second direction; and a rotation preventing member, adapted to come in contact with the roller when the support shaft is moved in the first direction, thereby preventing the roller from rotating.

With this configuration, when the loading of an excess sheet is about to occur, the outer circumferential surface of the stopper comes into contact with the excess sheet, and the roller is moved in the first direction by the frictional force generated between the excess sheet and itself. When the support shaft of the roller moves in the first direction, the rotation preventing member prevents rotation of the roller. When the roller stops rotating, since the excess sheet in contact with the outer circumferential surface of the roller cannot move in the first direction because of the frictional force, the loading of the sheet into the sheet cassette is prevented. When a sheet is about to move in the sheet feeding direction to be fed while sheets of paper within the specified amount are contained in the sheet cassette, although the outer circumferential surface of the roller is in contact with the sheet, the roller moves in the second direction because of the frictional force between the sheet and itself and becomes rotatable as the outer circumferential surface of the roller leaves the rotation preventing member. Thus, substantially no resistive force is generated against the movement of the sheet in the second direction.

Thus, the stopper configured as described above reliably prevents the loading of an excess sheet and allows sheets contained within the specified amount to be smoothly fed, and it therefore constitutes a one-way stopper mechanism which works effectively in a simple configuration.

The stopper also may comprise:

a pivot member; and a support shaft, supporting the pivot member so as to be pivotable between a first position and a second position, wherein:

the pivot member comes in contact with an uppermost one of the sheets contained in the space when the volume of the sheets reaches the maximum capacity to prevent the sheet from entering the space when the pivot member is placed in the first position; and the pivot member is separated from the uppermost sheet to allow the uppermost sheet to move in the second direction when the pivot member is placed in the second position.

With this configuration, when the loading of an excess sheet is about to occur, the excess sheet comes into contact with the rotating member, and the sheet is prevented from moving further in the first direction. When a sheet is about to move in the second direction to be fed while sheets within the specified amount are contained in the sheet cassette, although the rotating member contacts the sheet, the rotating member can rotate in the direction of retracting from the sheet moving in the sheet feeding direction. Therefore, substantially no resistive force is generated against the movement of the sheet in the second direction. Thus, the stopper configured as described above reliably prevents the loading of an excess sheet and allowing sheets contained within the specified amount to be smoothly fed, and it therefore constitutes a one-way stopper mechanism which works effectively in a very simple configuration.

The first direction may be the same direction as the second direction.

The stopper also may comprise:

a roller, adapted to come in contact with an uppermost one of the sheets contained in the space when the volume of the sheets reaches the maximum containing capacity;

a support shaft rotatably supporting the roller and movable between the first position and the second position;

a locking member, adapted to engage with the support shaft so as to prevent the roller from rotating when the support shaft is moved to the first position; and an urging member, urging the support shaft to the first position; and the support shaft may be disengaged from the locking member when the support shaft is moved to the second position, thereby allowing the roller to rotate.

With this configuration, the support shaft is normally urged by the urging member toward the first position, and the locking member and the support shaft are engaged with each other to stop the rotation of the roller. The roller can be easily switched from the rotation disabled condition to the rotatable condition by moving the support shaft. Therefore, when the loading of a sheet is about to occur, an excess sheet can be prevented from moving in the first direction by a frictional force originating from the roller that remains in the rotation disabled condition. When a sheet is to be fed, the roller can be switched to the rotatable condition to allow the sheet to be smoothly moved in the second direction.

The support shaft may be moved in the second direction when the sheet cassette is attached to the cassette receiver.

With this configuration, the stopper can be switched to the operating condition for preventing a sheet from moving and to the non-operating condition for allowing the sheet to move when the first direction and the second direction are the same. Therefore, by switching the mechanism to the operating condition when a sheet is to be loaded and to the non-operating condition when a sheet is to be fed, it is possible to feed sheets contained within the specified amount smoothly while preventing the loading of an excess sheet.

According to at least one embodiment of the invention, there is also provided an information processing apparatus, comprising:

a cassette receiver; and a sheet cassette, detachably attached to the cassette receiver and comprising:

a cassette body, formed with an opened space adapted to contain sheets therein; and a stopper, being movable relative to the cassette body and operable to prevent a sheet from moving in a first direction to enter the space when a volume of the sheets contained in the space reaches a maximum containing capacity, while allowing the sheets contained in the space to move in a second direction to be fed to the information processing apparatus.

With this configuration, the sheet cassette is not loaded with sheets in the excess of the specified amount, and it is possible to reliably prevent problems such as damage to a part for driving the sheet feeding unit and wrinkling or tearing of paper caused by an excessive load generated at the sheet feeding unit. Further, since the stopper of the sheet cassette does not prevent a sheet from moving in the first direction when the sheet has been once contained within the specified amount, the sheet feeding operation can be smoothly performed.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

An embodiment of a sheet cassette and information processing apparatus according to the invention will now be described in detail with reference to the accompanying drawings.

In the present embodiment, reference is made to an inkjet printer which performs a printing operation on paper as an example of the information processing apparatus. For example, information processing apparatus which can carry a sheet cassette according to the invention include printers, copying machines, and facsimiles.

Figure 1:
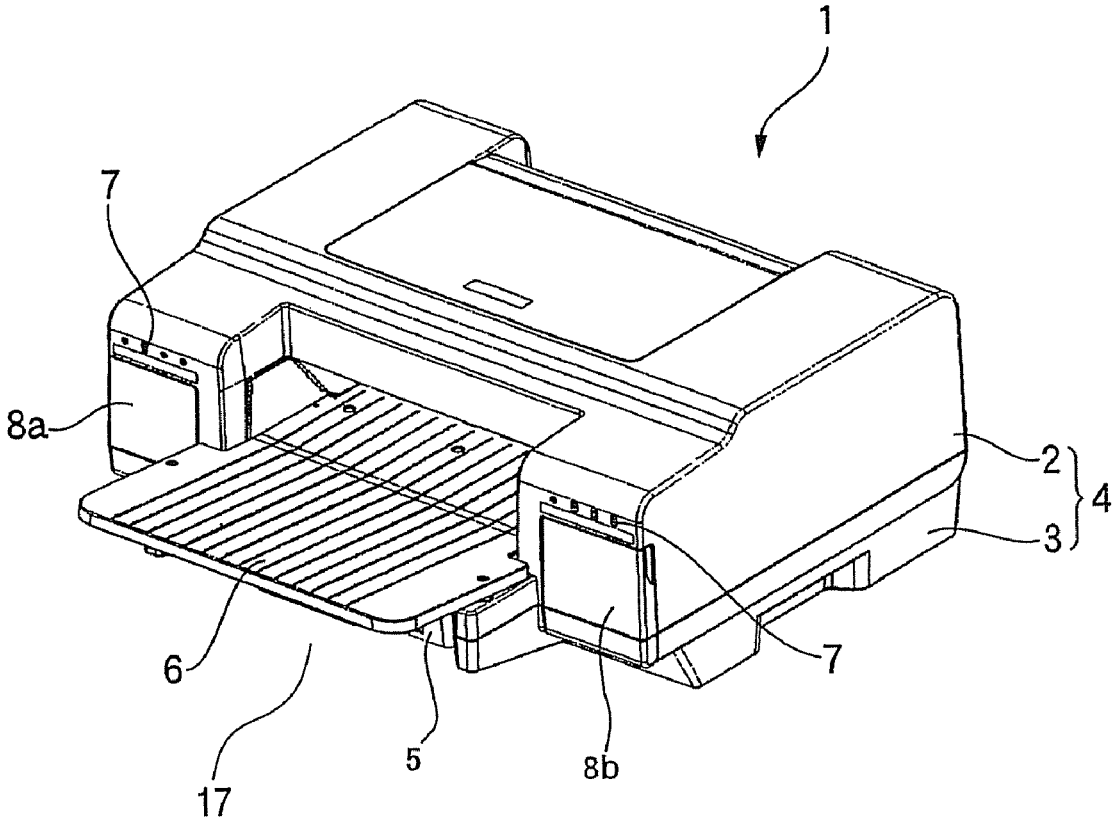
FIG. 1 is an external perspective view of an embodiment of an information processing apparatus in which a sheet cassette according to the invention is mounted.
Figure 2:
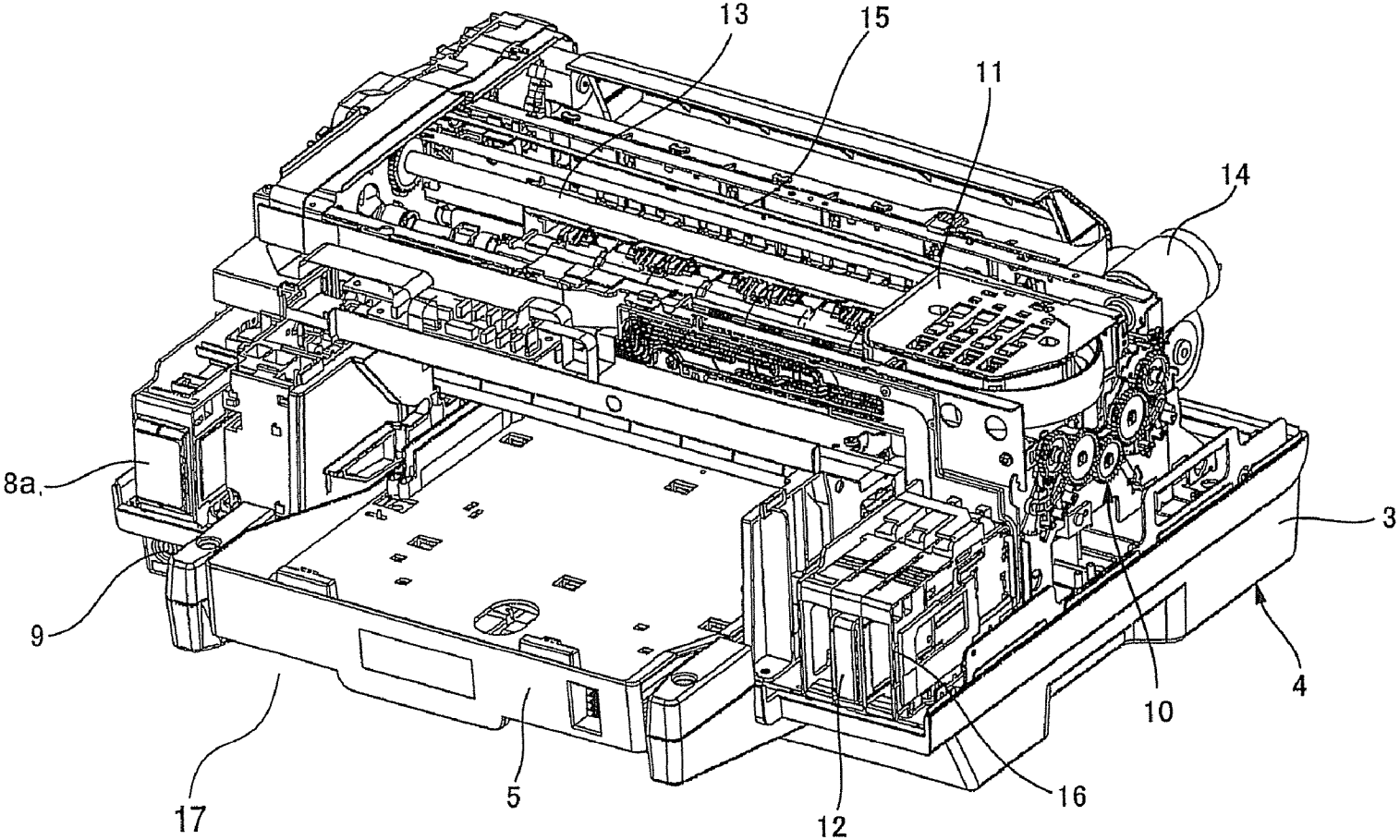
FIG. 2 is a perspective view of the information processing apparatus shown in FIG. 1, the apparatus being shown with a top case thereof removed.
Figure 3:
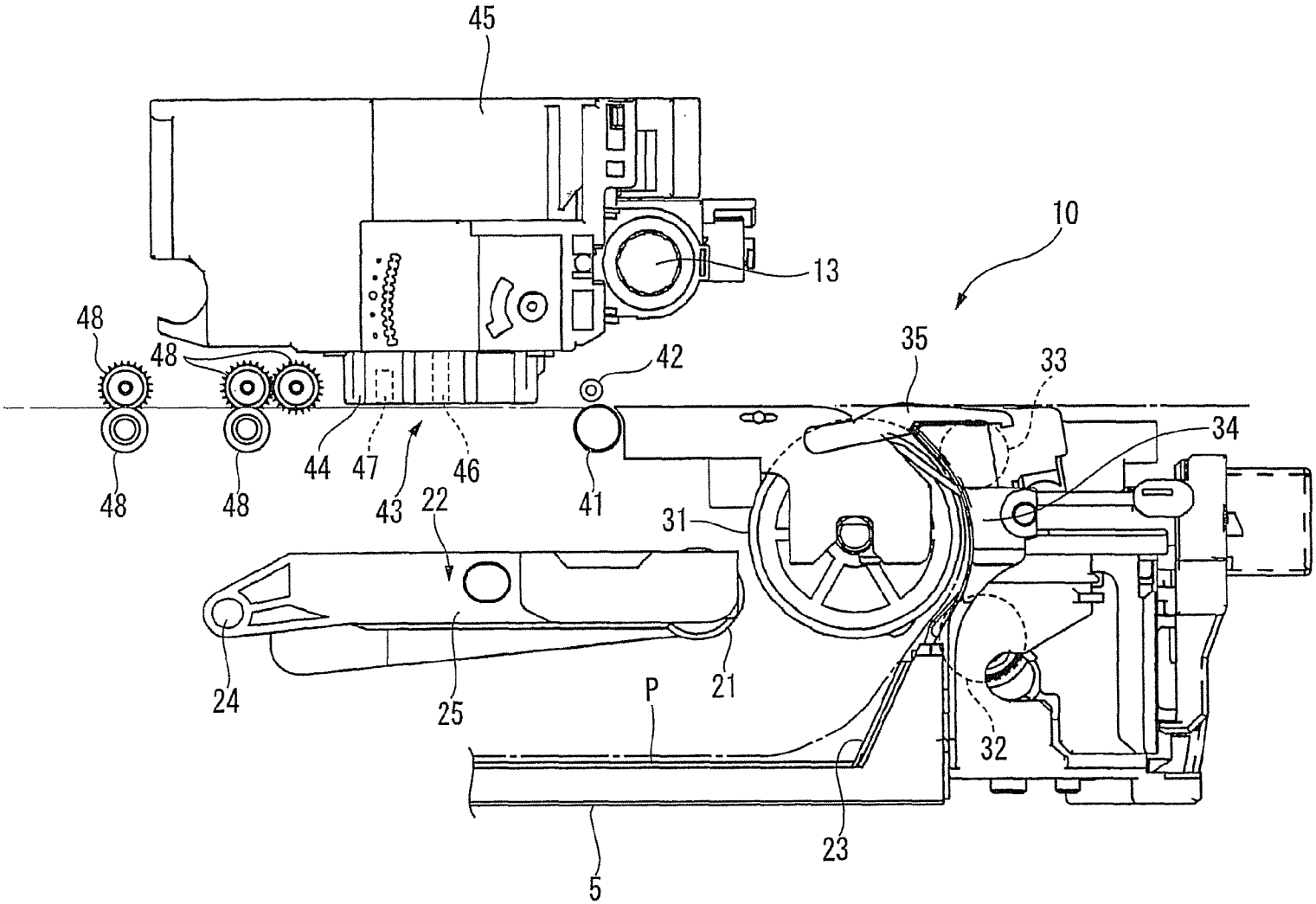
FIG. 3 is a side sectional view of the information processing apparatus shown in FIG. 1 showing a state of the same when a sheet is fed.
Figure 4:
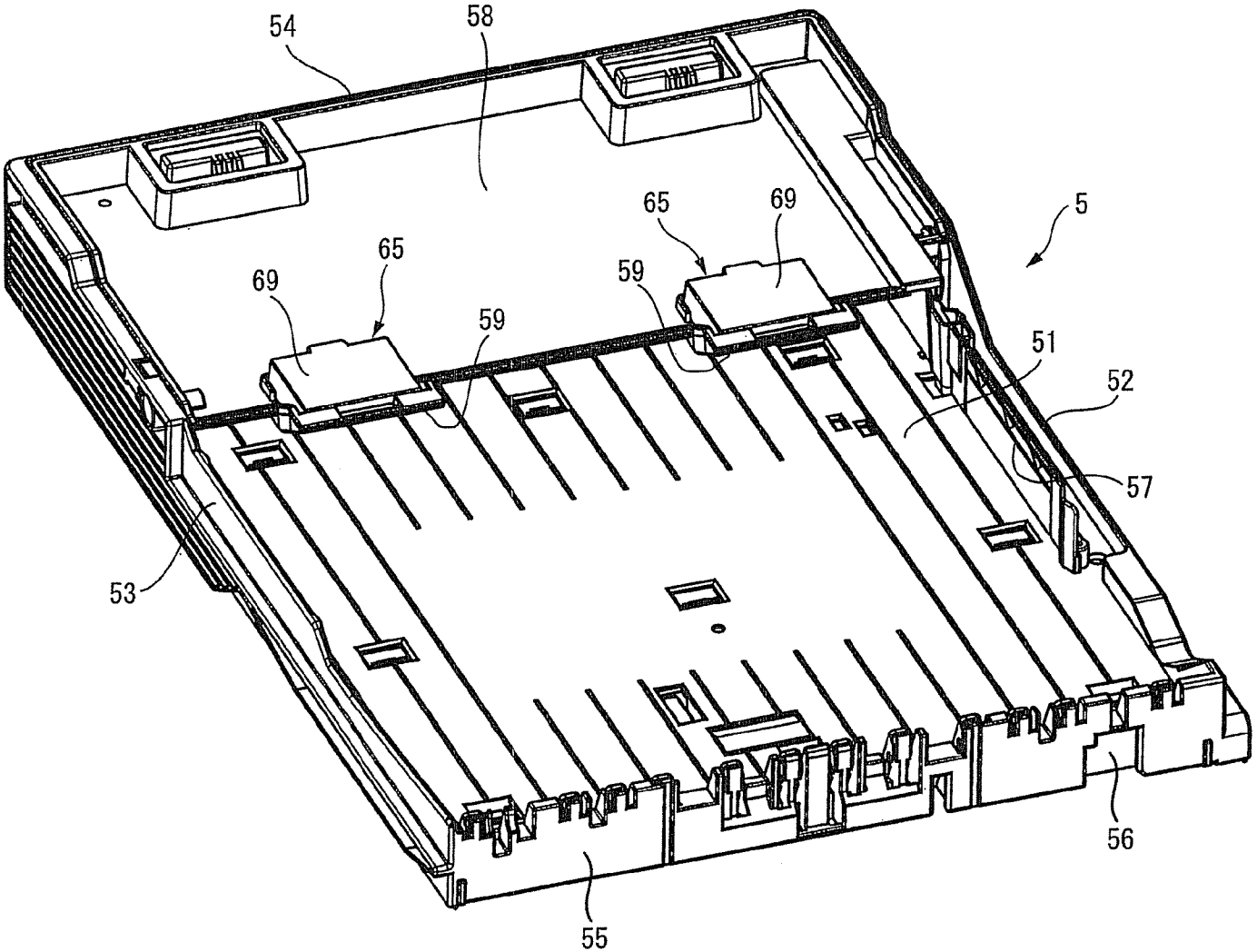
FIG. 4 is a perspective view of a sheet cassette mounted in a cassette containing portion of the information processing apparatus shown in FIGS. 1 to 3.
Figure 5:
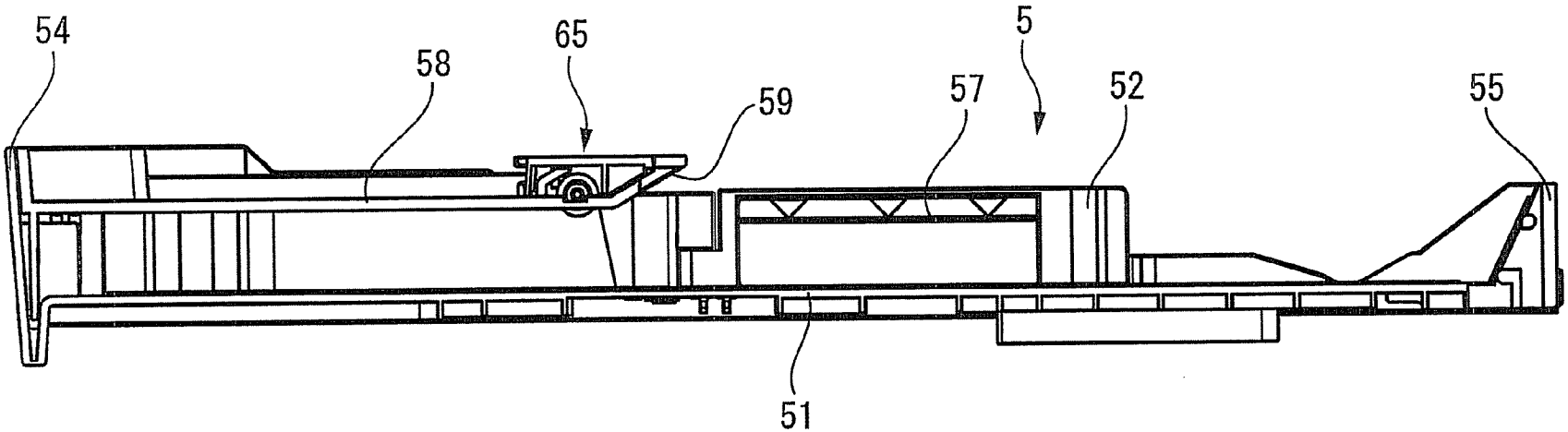
FIG. 5 is a sectional view of the sheet cassette shown in FIG. 4.
Figure 6:
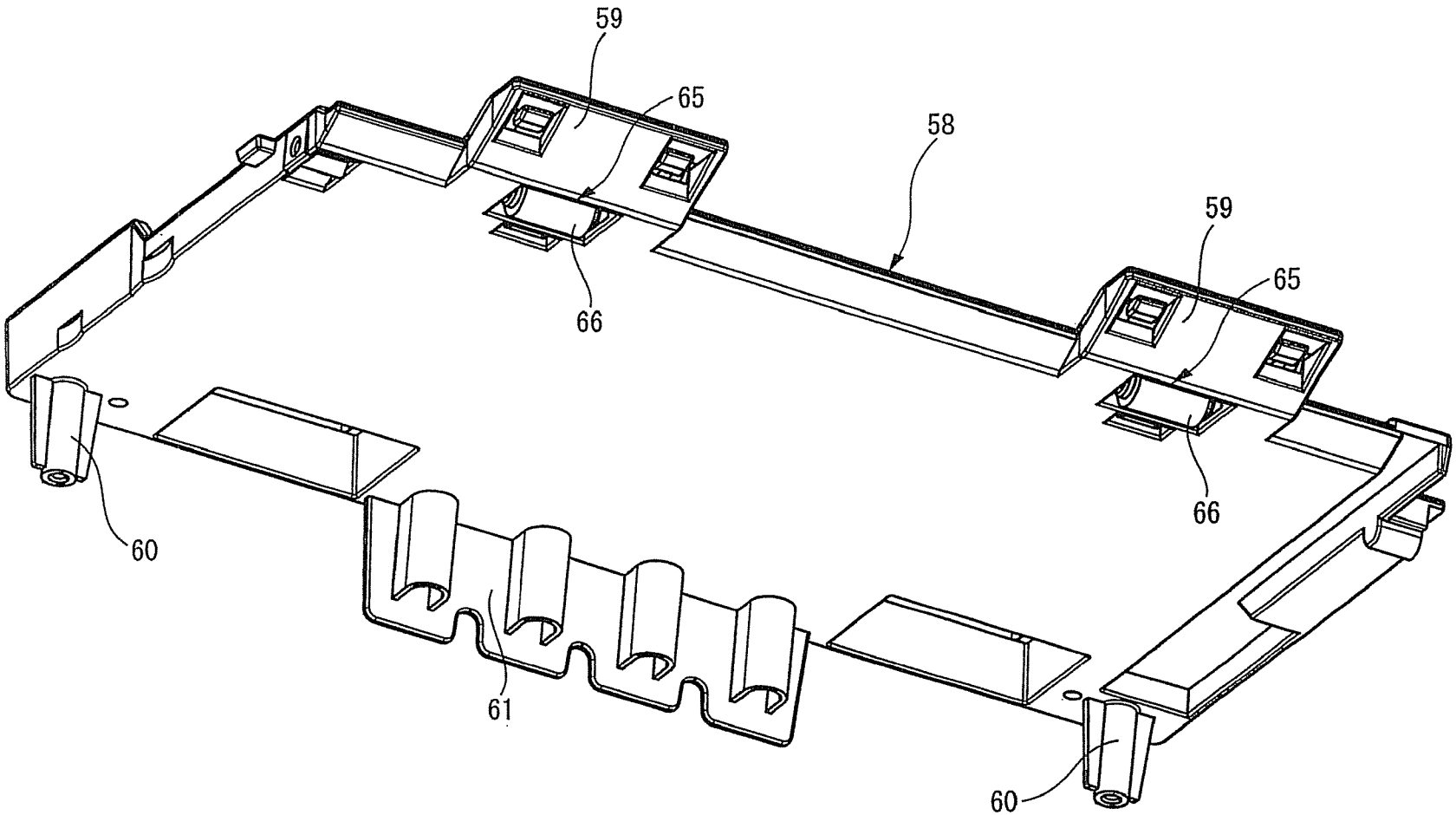
FIG. 6 is a perspective view of a cassette cover which is shown in FIGS. 4 and 5, obliquely taken from below the same.
Figure 7:
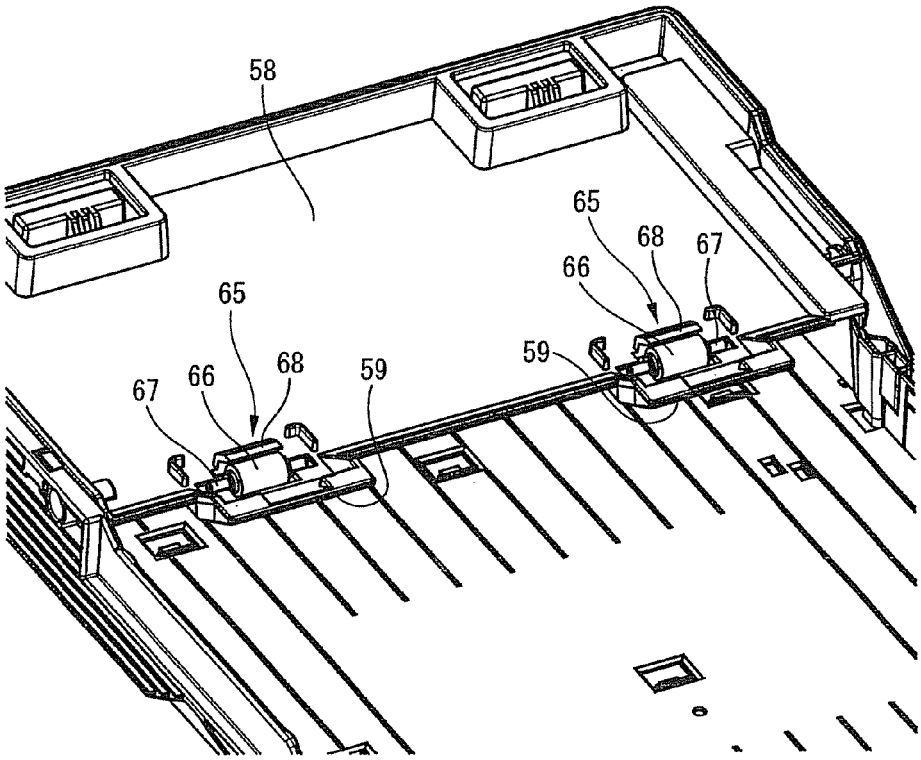
FIG. 7 is a perspective view of a stopper mechanism which is shown in FIG. 4, the mechanism being shown with a roller cover thereof removed.
Figure 8:
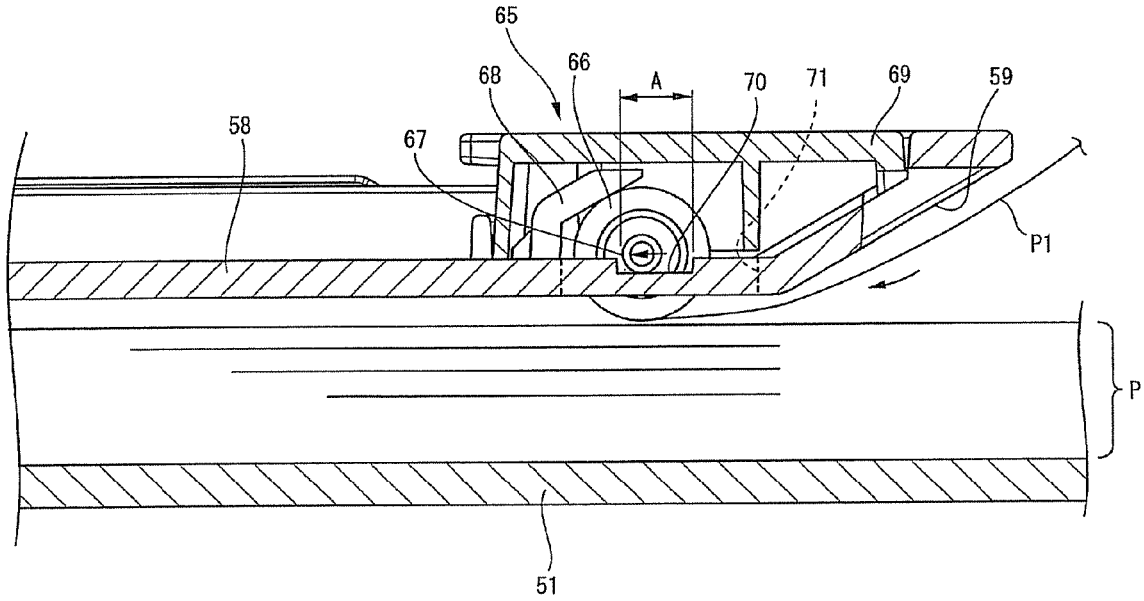
FIG. 8 is an enlarged sectional view of the stopper mechanism shown in FIG. 5 in a state in which the mechanism prevents the loading of an excess sheet.
Figure 9:
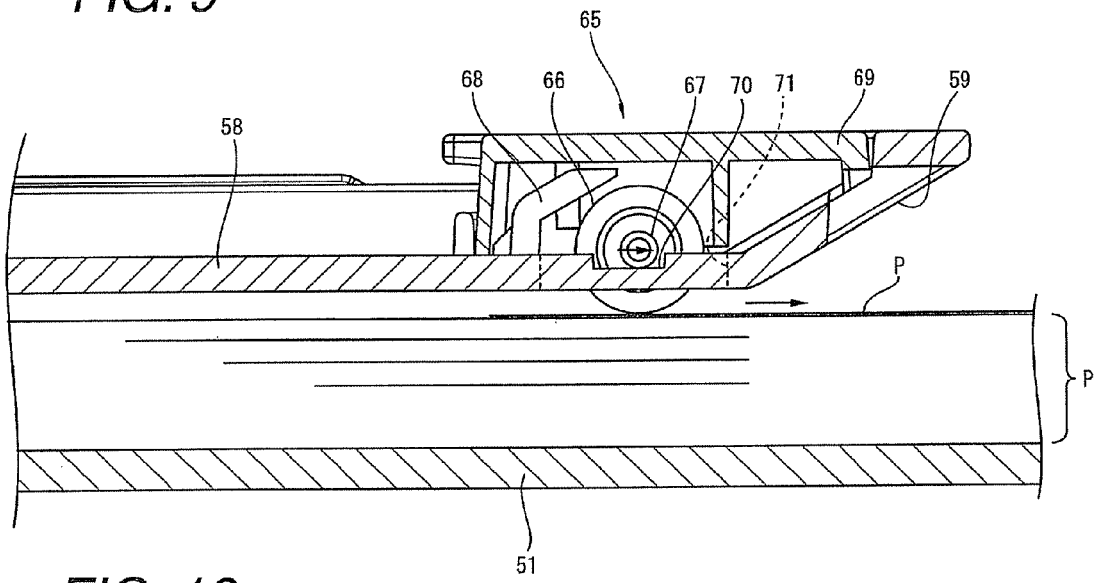
FIG. 9 is an enlarged sectional view of the stopper mechanism shown in FIG. 5 in a state in which the mechanism allows a sheet of paper to move when the sheet is to be fed.

FIG. 1 is an external perspective view of an embodiment of an information processing apparatus in which a sheet cassette according to the invention is mounted. FIG. 2 is a perspective view of the information processing apparatus shown in FIG. 1, the apparatus being shown with a top case thereof removed. FIG. 3 is a side sectional view of the information processing apparatus shown in FIG. 1 showing a state of the same when a sheet is fed. FIG. 4 is a perspective view of a sheet cassette mounted in a cassette containing portion of the information processing apparatus shown in FIGS. 1 to 3. FIG. 5 is a sectional view of the sheet cassette shown in FIG. 4. FIG. 6 is a perspective view of a cassette cover which is shown in FIGS. 4 and 5, obliquely taken from below the same. FIG. 7 is a perspective view of a stopper mechanism which is shown in FIG. 4, the mechanism being shown with a roller cover thereof removed. FIG. 8 is an enlarged sectional view of the stopper mechanism shown in FIG. 5 in a state in which the mechanism prevents the loading of an excess sheet. FIG. 9 is an enlarged sectional view of the stopper mechanism shown in FIG. 5 in a state in which the mechanism allows a sheet of paper to move when the sheet is to be fed.

A printer 1 of the present embodiment is a printer for business use of a front feed/discharge type. As shown in FIG. 1, a cassette containing portion 17 opens in the middle of a front face of an apparatus case 4 including a top case 2 and a bottom case 3, and a substantially box-like sheet cassette capable of containing sheets stacked over another is removably mounted in the cassette containing portion 17.

A discharge tray 6 for receiving a printed sheet is mounted above the sheet cassette 5. Display portions 7 including LED lamps for displaying states of operation are provided on both sides of the front face of the apparatus case 4.

A black ink cover 8*a* for covering the front of a black ink containing portion containing a black ink cartridge and a color ink cover 8*b* for covering the front of a color ink containing portion containing a plurality of color ink cartridges are provided in left and right positions, respectively, under the display portions 7.

Each of the black ink cover 8*a* and the color ink cover 8*b* is mounted such that it can be opened and closed. The ink cartridges which are removably mounted therein can be accessed by opening the respective covers 8*a* and 8*b*.

As shown in FIG. 2, a button type power switch 9 for turning power to the printer 1 on and off is provided under the black ink cover 8*a*. When the power switch 9 is turned on, power is supplied to a conveying mechanism 10, a printing process mechanism, a processing gap adjusting mechanism, a plurality of sensors, and control means to enable the printer 1 for operation.

As shown in FIG. 2, the apparatus case 4 contains the conveying mechanism 10 which conveys sheets of paper fed one at a time from the sheet cassette 5 by a pickup roller of a sheet feeding mechanism along a conveying path, a carriage 11 which is provided on the conveying path of the conveying mechanism 10 such that it can be moved back and forth in a direction orthogonal to the sheet conveying direction, a printing head (see FIG. 3) carried on a bottom surface of the carriage 11 for ejecting microscopic particles of recording ink onto a sheet of paper, and ink cartridges 12 for reserving the recording ink supplied to the printing head.

As shown in FIG. 3, the conveying mechanism 10 forms the conveying path which extends from the sheet cassette 5 to the discharge tray 6 via an arcuate conveying path. The conveying mechanism 10 includes an ASF (automatic sheet feeder) portion and a PF (paper feeder) portion.

The ASF portion includes a sheet feeding unit 22 for feeding sheets of paper P contained in the sheet cassette 5 one at a time toward the rear of the apparatus and an intermediate roller 31 and a guide portion 34 forming an arcuate conveying section which conveys the sheet P fed by the sheet feeding unit 22 along the arcuate conveying path.

The PF portion includes a pair of sheet conveying rollers 41 and 42 for sandwiching the sheet P conveyed from the arcuate conveying section to convey it to a printing position (processing position).

The ASF portion and the PF portion are dynamically coupled through a plurality of gears and can be driven by a single conveying motor (not shown).

The sheet feeding unit 22 is configured such that a rear end of a frame 25 where a pickup roller 21 for feeding a sheet is provided can be rotated in the vertical direction in the figure by a support pin 24. The pickup roller 21 of the sheet feeding unit 22 can be put in contact with the uppermost sheet of paper P in the sheet cassette 5 by a swing of the frame 25 in the vertical direction. When the printer 1 is at rest, the frame 25 is kept horizontal as shown in FIG. 2, and the pickup roller 21 of the sheet feeding unit 22 is thus kept away from the sheet P on the sheet cassette 5. When the sheet is to be fed, a downward rotation of the frame 25 about the support pin 24 urges the pickup roller 21 against the sheet P on the sheet cassette 5, and the rotation of the pickup roller 21 causes the sheet P on the sheet cassette 5 to abut on an inclined friction pad 23. The sheets of paper P are separated one at a time due to the frictional force and the viscosity of the paper P and fed into a gap between the intermediate roller 31 and the guide portion 34. When the printing portion 43 starts printing after a sheet is fed, the frame 25 is returned to the initial horizontal state as shown in FIG. 3.

The arcuate conveying section includes the guide portion 34 which is provided outside the section (on the side of the rear of the printer 1) and which is curved in the form of an arc and the intermediate roller 31 which is provided inside the section (on the side of the front of the printer 1) and which sends a sheet of paper P upward from below the guide portion 34. The guide portion 34 includes a retard roller 32 provided on the bottom side thereof and an assist roller 33 provided on the top side thereof. A sheet of paper P fed by the pickup roller 21 is sandwiched and conveyed by the intermediate roller 31 and the retard roller 32 and is further sandwiched and conveyed by the intermediate roller 31 and the assist roller 33. Thus, the sheet P is conveyed along the arcuate conveying path that is formed as a gap between the intermediate roller 31 and the guide portion 34, and the sheet is sent into a U-shaped conveying path with the leading edge thereof directed to the front of the apparatus.

The pair of sheet conveying rollers 41 and 42 is provided on the front side of the apparatus in a position at a predetermined distance from an exit end of the arcuate conveying path (a downstream end of the guide portion 34), and the rollers sandwich the sheet P sent from the arcuate conveying path through the substantially linear path and convey it to a position under the printing portion 43 or the printing position. The sheet P can be positioned relative to the printing portion by controlling the amount in which the sheet conveying rollers are driven for rotation.

The printing portion 43 as a processing portion includes the carriage 11 which has a printing head 44. The carriage 11 is supported such that it can move in the width direction of the paper on a carriage shaft 13 extending in the width direction of the paper. The carriage is also secured to a timing belt driven by a carriage motor 14 and moved back and forth in the width direction of the paper as the timing belt 15 travels (see FIG. 2).

The printing head 44 has an ejection nozzle 46 for ejecting ink toward the sheet of paper P. A plurality of guide rollers for sandwiching the sheet of paper P to guide it to the discharge tray 6 on the front side of the apparatus is provided downstream of the printing portion 43.

The printer 1 records (prints) characters and graphics on the sheet by ejecting ink from the printing head 44 carried on the carriage 11 in a sub-scanning direction that is the direction in which the sheet P is conveyed and a main scanning direction that is the moving direction of the carriage 11.

A description will now be made on the sheet cassette 5 removably mounted in the cassette containing portion 17 of the printer 1.

As shown in FIGS. 4 and 5, the sheet cassette 5 has a box-like structure which includes a bottom wall 51, a left side wall 52 and a right side wall 53 erected from left and right edges of the bottom wall 51, a front wall 54, and a rear wall 55 and which is open on the top side thereof. As shown in FIG. 3, a guide wall 23 for regulating a feeding direction of sheets of paper P contained in the sheet cassette 5 is formed inside and integrally with the rear wall 55 to which the leading edge of the cassette is directed when inserted in the cassette containing portion 17.

In order to send only the uppermost sheet of paper P to the conveying mechanism 10 (see FIG. 2) utilizing a difference between frictional forces acting on the top and bottom surfaces of the sheet P and the viscosity of the sheet P, as shown in FIG. 3, the guide wall 23 is inclined at a predetermined angle, and a part of the surface of the wall to be put in contact with the sheet is formed by a corkboard having high contact friction.

A cutout 56 is formed on the outside of the rear wall 55 in a position associated with cassette detecting means (not shown) provided in the cassette containing portion 17. The cassette detecting means includes a plurality of contact-type detection sensors and detects that the sheet cassette 5 is mounted when any of the sensors contacts the sheet cassette 5. The cutout 56 is set to be variable in shape depending on the type of the sheet cassette 5 (e.g., the type of the same depending on the size of sheets), and the plurality of detection sensors contact a sheet or not depending on the pattern of the cutout. Thus, some of the plurality of sensors will contact the rear wall 55 and some of the sensors will enter the cutout 56 instead of contacting the wall, which allows the type of the sheet cassette 5 formed with the cutout 56 in a predetermined shape to be determined.

Insertion guide structures (not shown) for the mounting of the sheet cassette 5 into the cassette containing portion 17 are formed on the outside of the left side wall 52 and the right side wall 53 to allow the sheet cassette 5 to be easily and straightly inserted to a proper position.

Marks 57 indicating a specified containable amount of paper which is set in advance are provided on the inside of the left side wall 52 and the right side wall 53. That is, a user can visually determine whether the top of sheets of paper contained one over another in the sheet cassette 5 reaches the height of the marks 57, whereby sheets of paper can be loaded such that they will not exceed the specified amount.

A cassette cover 58 is mounted on the sheet cassette 5 to cover the open top side of the sheet cassette 5 when the cassette is mounted in the cassette containing portion 17. When the top side of the sheet cassette 5 mounted in the cassette containing portion 17 opens on the outside of the printer 1, sheets of paper can be loaded through the narrow opening while the sheet cassette 5 is kept mounted. The sheets can cause a feeding error or jam because they may be skewed in the sheet cassette 5 when loaded through the narrow opening. The cassette cover 58 prevents sheets of paper from being loaded while the sheet cassette 5 is kept mounted in the cassette containing portion 17. When the cassette cover 58 is mounted, the sheet cassette 5 must be removed from the cassette containing portion 17 to load it with sheets of paper. Thus, the sheets of paper are properly set in the sheet cassette 5.

Since the cassette cover 58 is mounted, a front part of the top side of the sheet cassette 5 (the rear side of the cassette in the direction of insertion of the same into the cassette containing portion 17) is covered. Therefore, when the sheet cassette 5 is loaded with sheets of paper, the sheets are inserted from the front side of the sheet cassette 5, which is open, toward the region under the cassette cover 58. That is, the sheet loading direction is a direction from the right side of FIG. 5 to the left side of the same. The direction in which sheets of paper are fed by the sheet feeding unit 22 is a direction from the left side of FIG. 5 to the right side of the same. Thus, the sheet loading direction and the sheet feeding direction are opposite to each other.

As shown in FIGS. 5 and 6, the cassette cover 58 is formed with inclined guide surfaces 59 for inserting sheets of paper under the cassette cover 58, and sheets of paper are thus smoothly guided toward the region under the cassette cover 58. As shown in FIG. 6, engaging portions 60 and 61 which are positioned by being engaged near the rear end of the sheet cassette 5 are formed on the bottom of the cassette cover 58, and they allow the cassette cover 58 to be positioned and secured on the sheet cassette 5.

Stopper mechanisms 65 are provided in positions which are adjacent to the guide surfaces 59 of the cassette cover 58 in the sheet loading direction, the mechanisms preventing an excess sheet which is about to be loaded in the excess of the specified amount for the sheet cassette 5 from moving in the sheet loading direction and allowing a sheet of paper to move in the sheet feeding direction.

As shown in FIGS. 5 to 9, the stopper mechanisms 65 includes rollers 66 which contact the excess sheet on outer circumferential surfaces thereof to generate a frictional force, support shafts 67 which constitute rotating shafts of the rollers 66 and for which a movable range A of a predetermined distance is set in the sheet loading direction and the sheet feeding direction, and rotation stopping portions 68 which contact the outer circumferential surfaces of the rollers 66 to prevent the rollers 66 from rotating when the support shafts 67 are at the end of the movable range A in the sheet loading direction.

The rollers 66 are provided in openings 71 (see FIG. 8) formed on the cassette cover 58 such that they can be put in contact with sheets of paper P inserted to the region under the cassette cover 58. Lower ends of the rollers 66 are in positions which substantially agree with the specified height of the sheets of paper P, and they contact an excess sheet P1 which is about to be loaded in the excess of the specified amount. The outer circumferential surfaces of the rollers 66 are lined with rubber, and the outer circumferential surfaces generate a frictional force between a sheet of paper and themselves when they contact the sheet of paper. The support shafts 67 constituting rotating shafts of the rollers 66 are supported in recesses 70 formed on the cassette cover 58 so as to extend in the direction of the axes of the rollers 66. The recesses support the support shafts 67 such that the shafts can move in the sheet loading direction and the sheet feeding direction.

The rotation stopping portions 68 are positioned so as to abut on the outer circumferential surfaces of the rollers when the support shafts 67 are moved in the recesses 70 to predetermined positions in the sheet loading direction, and they stop the rotation of the rollers 66 with a frictional force when they abut on the rollers 66. The rotation stopping portions 68 have inclined surfaces in positions thereof in contact with the rollers 66 to exert a force which moves the rollers 66 toward the recesses 70 when they abut on the rollers. Thus, the rotation of the rollers 66 is prevented and, in addition, the support shafts 67 are urged against the recesses 70 to prevent the rollers 66 from being lifted up by a sheet of paper. Therefore, the rollers 66 can be kept stable in the rotation disabled state.

When the rollers 66 abut on the rotation stopping portions 68, the movement of the support shafts 67 is obviously limited. Specifically, when the rollers 66 abut on the rotation stopping portions 68, the support shafts 67 are located at the extremities in the sheet loading direction up to which the shafts 67 can move. The extremities to which the support shafts 67 can move are determined by the end of the recesses 70 (the right ends in FIG. 8). As thus described, the movable range A of a predetermined distance is set for the support shafts 67 in the sheet loading direction and sheet feeding direction.

In order to prevent the support shafts 67 from coming out the recesses 70 and the rollers 66 from jumping up obliquely to the sheet feeding direction (upward and to the right in FIG. 8) consequently, the stopper mechanisms 65 are provided with roller covers 69. FIG. 7 shows the mechanisms with the roller covers 69 removed.

When the excess sheet P1 is about to be loaded, the outer circumferential surfaces of the rollers 66 of the stopper mechanisms 65 contact the excess sheet P1, and the rollers 66 are rotated by a frictional force between the excess sheet P1 and themselves to move in the sheet loading direction. When the support shafts 67 of the rollers 66 move to the end of the movable range A in the sheet loading direction, the outer circumferential surfaces of the rollers 66 abut on the rotation stopping portions 68 to stop the rotation of the rollers 66. When the rollers 66 stop rotating, the excess sheet P1 in contact with the outer circumferential surfaces of the rollers 66 is prevented by the frictional force from moving any further in the sheet loading direction, whereby the loading of the sheet into the sheet cassette 5 is prevented. It is therefore possible to reliably prevent problems resulting from overloading such as damage to the part for driving the sheet feeding unit 22 and wrinkling or tearing of the paper P being fed caused by an excessive load generated at the sheet feeding unit 22.

When the uppermost sheet of paper P is about to move in the sheet feeding direction to be fed while sheets of paper P within the specified amount are contained in the sheet cassette 5, although the outer circumferential surfaces of the roller 66 are in contact with the sheet P, the rollers move in the sheet feeding direction because of the frictional force between the sheet P and the rollers and become rotatable as the outer circumferential surfaces of the rollers 66 leave the rotation stopping portions 68. Even when the support shafts 67 are moved to the end of the movable range A in the sheet feeding direction, the rollers 66 are kept in a rotatable state in that position. Thus, the stopper mechanisms 65 generate substantially no resistive force against the movement of the sheet P in the sheet feeding direction.

Thus, the stopper mechanisms 65 configured as described above reliably prevent the loading of an excess sheet P1 and allows smooth feeding of sheets of paper P which are contained within the specified amount, and they constitute one-way stopper mechanisms which work effectively in a simple configuration.

Since the stopper mechanisms 65 of the present embodiment are provided on the cassette cover 58, an excess sheet P1 will not be caught between the cassette cover 58 and the bottom wall 51 by being forcibly loaded in the excess of the specified amount. Thus, the loading of the excess sheet P1 can be reliably prevented.

As described above, when the sheet loading direction and the sheet feeding direction are opposite to each other, the one-way stopper configuration may be employed to prevent the excess sheet P1 from moving in the sheet loading direction. Then, sheets of paper P contained within the specified amount can be smoothly fed while preventing an excess sheet P1 from being loaded. The configuration of the one-way stopper mechanism is not limited to that of the above-described stopper mechanism 65, and stopper mechanisms in various configurations may be employed. For example, a roller incorporating a one-way clutch may be used as a stopper mechanism.

Figure 10:
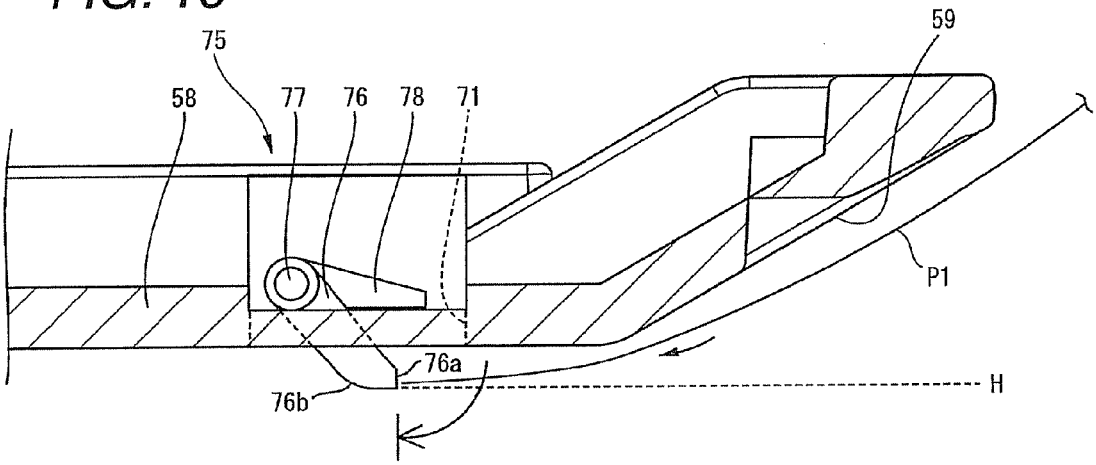
FIG. 10 is an enlarged sectional view of another embodiment including a configuration of the stopper mechanism that can be used in the sheet cassette according to the invention showing a state of the same in which the mechanism prevents the loading of an excess sheet.
Figure 11:
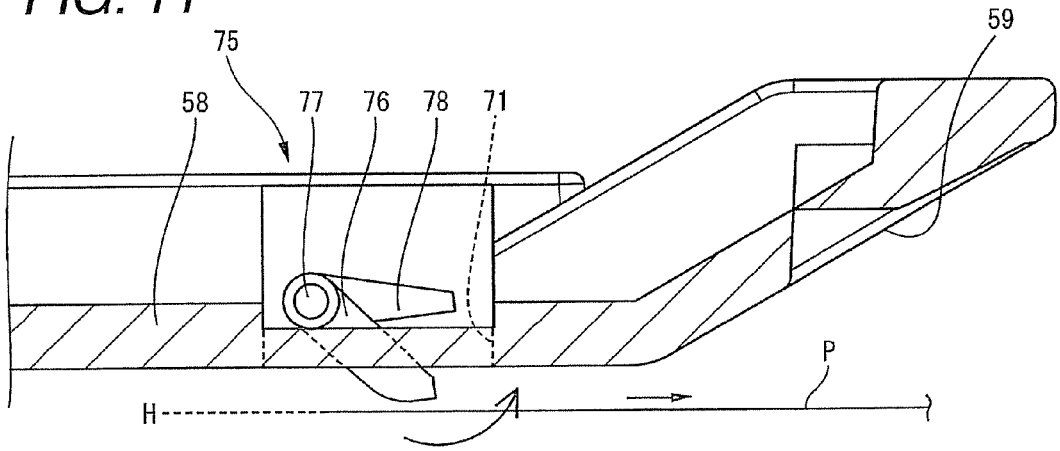
FIG. 11 is an enlarged sectional view of the stopper mechanism shown in FIG. 10 in a state in which the mechanism allows a sheet of paper to move when the sheet is to be fed.

FIGS. 10 and 11 show an example of a one-way stopper mechanism which can be used in the sheet cassette according to another embodiment of the invention.

A stopper mechanism 75 shown in FIGS. 10 and 11 includes a rotating member 76 which is rotatably pivoted and a support member 78 for supporting the rotating member 76 in a position where the rotating member abuts on an excess sheet P1 to prevent it from moving in the sheet loading direction (the direction from the right side of the figures to the left side of the same). The rotating member 76 can rotate in the direction of retracting from a sheet of paper P moving in the sheet feeding direction (the direction from the left side of the figures to the right side of the same).

The rotating member 76 is in the form of a flap piece disposed in an opening 71 formed on the cassette cover 71, and it is rotatably supported by a support shaft 77 at a top end thereof. The support shaft 77 is rotatably positioned directly above the opening 71. A support member 78 is integrally supported by the support shaft 77 to be rotatable along with the rotating member 76, and it is normally disposed above an edge of the opening 71 and supported such that it is always positioned higher than the opening 71. The rotating member 76 is supported by the support member 78 so as to protrude a predetermined distance below the opening 71 at a predetermined angle. The end of the rotating member 76 is positioned at a height H that is the specified amount of sheets of paper P, and the end abuts on an excess sheet P1 which is about to be loaded in the excess of the specified amount.

In order to reliably prevent the excess sheet P1 from moving in the sheet loading direction when the rotating member 76 abuts on the excess sheet P1, an abutting portion 76*a* is provided in a position where it is opposite to the sheet loading direction in order to abut on the excess sheet P1 substantially at a right angle. The rotating member 76 is also provided with a slide-contact portion 76*b* formed with a surface having a great curvature in a position where it is opposite to the sheet feeding direction.

In the stopper mechanism 75, when there is an excess sheet P1 which is about to be loaded in the excess of the height H or the specified amount, the excess sheet P1 abuts on the abutting portion 76*a* of the rotating member 76, and it is prevented from moving in the sheet loading direction further.

Let us assume that sheets of paper P within the specified amount are contained in the sheet cassette 5, and a sheet of paper P is about to move in the sheet feeding direction to be fed. Then, although the rotating member 76 contacts the sheet, no resistive force is generated against the movement of the sheet P in the sheet feeding direction because the member is rotatable in the direction of retracting from the sheet P moving in the sheer feeding direction as shown in FIG. 11 (upward). As thus described, the stopper mechanism 75 reliably prevents the loading of an excess sheet P1 and allows the sheets of paper P contained to or below the height H or the specified amount to be smoothly fed, and it therefore constitutes a one-way stopper mechanism which works effectively in a quite simple configuration.

A description will be made on a configuration of a stopper mechanism to be used when a sheet loading direction and a sheet feeding direction are the same.

A sheet loading direction and a sheet feeding direction may be the same when the sheet cassette 5 has a configuration in which the front wall 54 extends further forward (to the left in FIG. 5) or a configuration in which the front wall 54 opens and closes. A stopper mechanism to be used in such a case is required to be switchable between an operating condition for preventing a sheet from moving regardless of the moving direction of the sheet and a non-operating condition for allowing a sheet to move. That is, a stopper mechanism switchable between an operating condition for preventing a sheet from moving and a non-operating condition for allowing a sheet to move may be employed and switched to the operating condition when a sheet is loaded and to the non-operating condition when the sheet cassette is mounted or a sheet is fed from the same. Thus, sheets of paper contained within a specified amount can be smoothly fed while preventing the loading of an excess sheet.

Figure 12:
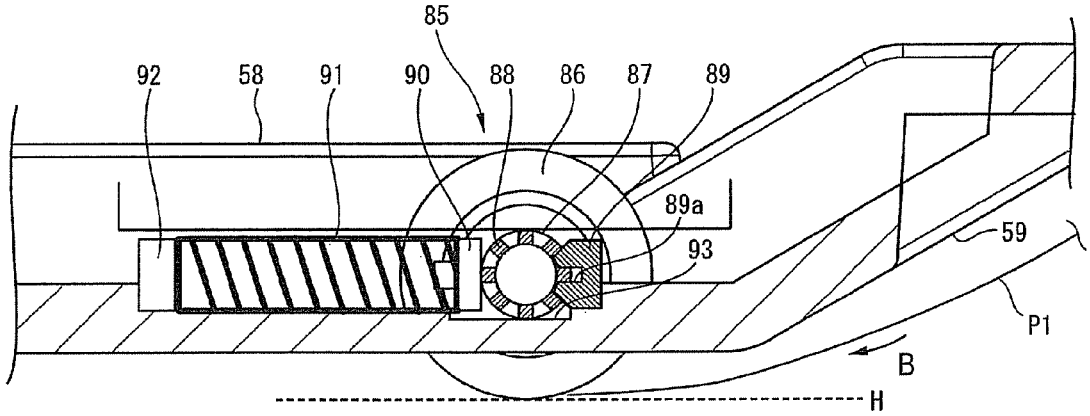
FIG. 12 is an enlarged sectional view of another embodiment including a configuration of a stopper mechanism switchable between an operating condition and a non-operating condition that can be used in the sheet cassette according to the invention showing a state of the same in which the mechanism prevents the loading of an excess sheet.
Figure 13:
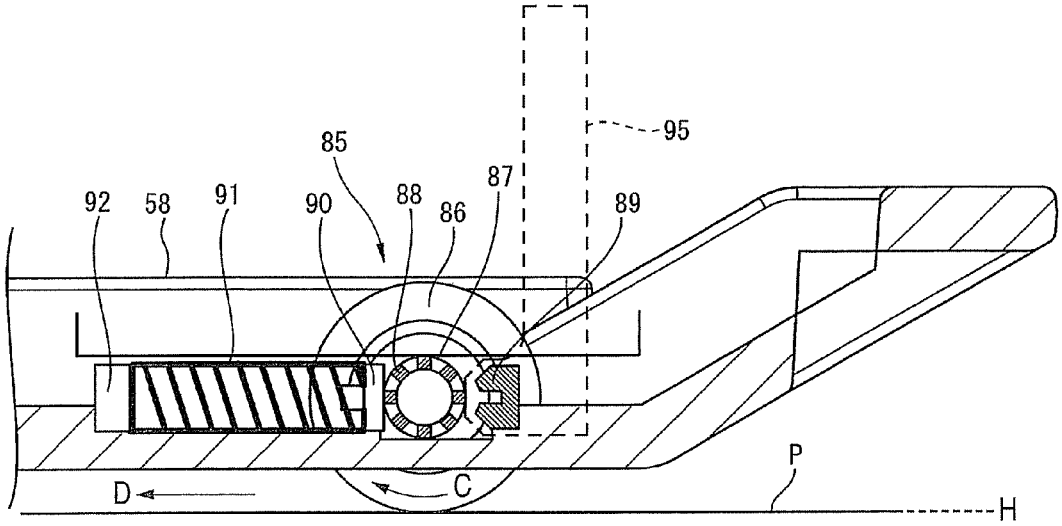
FIG. 13 is an enlarged sectional view of the stopper mechanism shown in FIG. 12 in a state in which the mechanism allows a sheet of paper to move when the sheet is to be fed.

FIGS. 12 and 13 show an example of a stopper mechanism switchable between an operating condition and a non-operating condition.

First, FIG. 12 shows a stopper mechanism 85 in an operating condition. The stopper mechanism 85 includes a roller 86 which contacts an excess sheet P1 being loaded in the direction of the arrow B at an outer circumferential surface thereof to generate a frictional force, a support shaft 87 which constitutes a rotating shaft of the roller 86 and for which a predetermined movable range is set, a lock portion 89 which engages the support shaft 87 to stop the rotation, and an urging portion 90 for urging the support shaft 87 toward the lock portion 89. The roller is switched from a rotation disabled condition to a rotatable condition as shown in FIG. 13 by moving the support shaft 87 against the urging force of the urging portion 90 to disengage it from the lock portion 89.

The roller 86 is disposed in an opening formed on the cassette cover 58, and it can be put in contact with sheets of paper P inserted below the cassette cover 58. A lower end of the roller 86 is in a position which is substantially the same the height H that is the specified amount of sheets of paper P, and the end abuts on an excess sheet P1 which is about to be loaded in the excess of the specified amount. An outer circumferential surface of the roller 86 is lined with rubber, and the outer circumferential surface generates a frictional force when put in contact with the sheet.

The support shaft 87 constituting the rotating shaft of the roller 86 extends in the axial direction of the roller 86 to be supported in a recess 93 formed on the cassette cover 58. In the recess 93, the support shaft 87 is supported so as to be movable within a predetermined range in the sheet loading direction and the sheet feeding direction. The support shaft 87 is always urged in the sheet feeding direction by an urging portion 90 which is energized by repulsion of a spring 91 supported on a based member 92 positioned on the cassette cover 58. The lock portion 89 which is formed with an engaging groove 89*a* is provided opposite to the urging portion 90, and a protrusion 88 formed on the support shaft 87 is urged by the urging force of the urging portion 90 into engagement with the engaging groove 89*a* to prevent the support shaft 87 from rotating.

As a result, the stopper mechanism 85 is in a rotation disabled state in which the rotation of the roller 86 is stopped. When the roller 86 is in the rotation disabled state, an excess sheet P1 inserted in the excess of the specified amount, the roller contacts the outer circumferential surface of the roller 86. Since the sheet is disallowed to move in the sheet loading direction further by a frictional force between the roller 86 and itself, the loading of the sheet in the sheet cassette 5 is prevented.

In a printer 1 having a cassette containing portion 17 in and from which a sheet cassette 5 having such a stopper mechanism 85 can be mounted and removed, switching means is preferably provided to put the stopper mechanism 85 in the non-operating condition at least when a sheet is to be fed.

For example, as shown in FIG. 13, a lever member 95 may be provided in the cassette containing portion as switching means for moving the support shaft 87 against the urging force of the urging portion 90 to disengage the support shaft 87 from the lock portion 89 with the sheet cassette 5 mounted in the cassette containing portion 17. In this case, since the stopper mechanism 85 is automatically switched to the non-operating condition in conjunction with an operation of mounting the sheet cassette 5, a sheet feeding operation can be smoothly performed without being hindered by the stopper mechanism. Referring to FIG. 13, since the roller 86 can rotate in both directions, the sheet loading direction indicated by the arrow B and the sheet feeding direction indicated by the arrow C for a sheet in the sheet cassette can be made the same.

In a printer 1 having a sheet cassette 5 having such a stopper mechanism 85 and the lever member 95, the stopper mechanism 85 is in the operating condition to prevent the loading of an excess sheet P1 when the sheet cassette 5 is removed from the cassette containing portion 17. When the sheet cassette 5 is mounted in the cassette containing portion 17, the stopper mechanism 85 is in the non-operating condition to allow a sheet to be smoothly fed without preventing the sheet feeding. Therefore, the stopper mechanism 85 can be always kept in a proper condition by the operation of mounting and removing the sheet cassette 5.

The lever 95 may switch the stopper mechanism 85 to the non-operating condition in an occasion other the mounting of the sheet cassette 5 in the cassette containing portion 17. For example, the lever 95 may operate in conjunction with a sheet feeding operation of the sheet feeding unit 22 to switch the stopper mechanism 85 to the non-operating condition.

The sheet cassette 5 having the stopper mechanism 85 can be used also in a printer which has no lever member 95. In this case, a member to substitute the lever member 95 may be provided on the sheet cassette 5 to switch the stopper mechanism 85 to the non-operating condition before the cassette is mounted in the cassette containing portion 17.

The invention claimed is:

1. A sheet cassette adapted to be detachably attached to a cassette receiver of an information processing apparatus, the sheet cassette comprising:

a cassette body formed with an opened space adapted to contain sheets therein;

a stopper comprising a roller adapted to come in contact with an uppermost one of the sheets contained in the opened space when a volume of the sheets reaches a maximum containing capacity of the opened space, a support shaft rotatably supporting the roller and movable in the first direction and the second direction, and a rotation preventing member adapted to come in contact with the roller when the support shaft is moved in a first direction, thereby preventing the roller from rotating, wherein the roller is movable relative to the cassette body operable to prevent a sheet from moving in the first direction to enter the opened space when a volume of the sheets contained in the opened space reaches the maximum containing capacity, while allowing the sheets contained in the opened space to move in a second direction opposite to the first direction to be fed to the information processing apparatus.

2. The sheet cassette as set forth in claim 1, further comprising a cassette cover partly covering the opened space of the cassette body, wherein the stopper is provided with the cassette cover.

3. An information processing apparatus, comprising:

a cassette receiver; and a sheet cassette adapted to be detachably attached to the cassette receiver, the sheet cassette including:

a cassette body formed with an opened space adapted to contain sheets therein;

a stopper comprising a roller adapted to come in contact with an uppermost one of the sheets contained in the opened space when a volume of the sheets reaches a maximum containing capacity of the opened space, a support shaft rotatably supporting the roller and movable in the first direction and the second direction, and a rotation preventing member adapted to come in contact with the roller when the support shaft is moved in a first direction, thereby preventing the roller from rotating, wherein the roller is movable relative to the cassette body and operable to prevent a sheet from moving in the first direction to enter the opened space when a volume of the sheets contained in the opened space reaches the maximum containing capacity, while allowing the sheets contained in the opened space to move in a second direction to be fed to the information processing apparatus.

4. A sheet cassette adapted to be detachably attached to a cassette receiver of an information processing apparatus, the sheet cassette comprising:

a cassette body formed with an opened space adapted to contain sheets therein;

a moving member adapted to come in contact with an uppermost one of the sheets loaded in the opened space and move relative to the cassette body in a sheet loading direction when a volume of the sheets reaches a maximum containing capacity of the opened space; and a rotation preventing member adapted to come in contact with the moving member when the moving member is moved in the sheet loading direction, thereby stopping the moving member from rotating.

5. The sheet cassette as set forth in claim 4, further comprising a cassette cover partly covering the opened space of the cassette body, wherein the moving member and the rotation preventing member is provided in the cassette cover.

6. The sheet cassette as set forth in claim 4, wherein the moving member has an outer surface;

wherein the uppermost one of the sheets comes in contact with the outer surface at one side of the moving member; and wherein the rotation preventing member comes in contact with the outer surface at another side of the moving member.

7. The sheet cassette as set forth in claim 4, wherein the rotation preventing member has a contact surface; and wherein the contact surface is inclined with respect to the sheet loading direction.

8. An information processing apparatus, comprising:

a cassette receiver; and a sheet cassette adapted to be detachably attached to the cassette receiver, the sheet cassette including:

a cassette body formed with an opened space adapted to contain sheets therein;

a moving member adapted to come in contact with an uppermost one of the sheets loaded in the opened space and move relative to the cassette body in a sheet loading direction when a volume of the sheets reaches a maximum containing capacity of the opened space, the moving member being movable relative to the cassette body in a sheet loading direction; and a rotation preventing member adapted to come in contact with the moving member when the moving member is moved in the sheet loading direction, thereby stopping the moving member from rotating.

* * * * *